US007351073B2

(12) United States Patent
Kemp et al.

(10) Patent No.: US 7,351,073 B2
(45) Date of Patent: Apr. 1, 2008

(54) ELECTRICAL CONNECTOR

(75) Inventors: Adam M. Kemp, Boardman, OH (US); John L. Wicks, Cortland, OH (US); Michael Mellott, Youngstown, OH (US); Robert C. Beer, Noblesville, IN (US); Joseph Gregory Tackett, Elwood, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/643,522

(22) Filed: Dec. 21, 2006

(65) Prior Publication Data

US 2007/0178724 A1 Aug. 2, 2007

Related U.S. Application Data

(60) Provisional application No. 60/762,931, filed on Jan. 27, 2006.

(51) Int. Cl.
*H01R 12/00* (2006.01)

(52) U.S. Cl. ..... 439/79

(58) Field of Classification Search ..... 439/712, 439/686, 701, 752, 954, 79
See application file for complete search history.

(56) References Cited

U.S. PATENT DOCUMENTS 6,179,671 B1 * 1/2001 Ohsumi ..... 439/752

* cited by examiner

*Primary Examiner*—Ross Gushi
(74) *Attorney, Agent, or Firm*—David P. Wood

(57) ABSTRACT

An electrical connector has a connect or shroud. A pin block disposed in the connector body supports a plurality of terminal pins that have head portions projecting out a forward end of the pin block and tail portions projecting out a rearward end of the pin block. The connector shroud has a socket at a forward end that receives a terminal stabilizer that is locked to the pin block to hold the terminal stabilizer and the pin block in assembly with the connector shroud to form a module. The module may include a block seal that can be sandwiched between the terminal stabilizer and the pin block during assembly of the module. The rear end of the connector shroud is truncated at an angle for a direct top down assembly of the module to a housing that has an attachment collar that is truncated at the same angle. The pin terminal tail portions are bent at a right angle and project through holes in a pin alignment member and a printed circuit board that are mounted inside the housing.

16 Claims, 3 Drawing Sheets

ELECTRICAL CONNECTOR

REFERENCE TO RELATED APPLICATIONS

This patent application claims priority to Provisional Patent Application No. 60/762,931 filed Jan. 27, 2006.

BACKGROUND OF THE INVENTION

This invention relates generally to an electrical connector that attaches to a housing having an internal printed circuit board and to a process for making such a electrical connector.

SUMMARY OF THE INVENTION

The electrical connector of the invention has one or more of the following features:

An electrical connector that includes terminal pins and a module comprising a pin block, and a terminal stabilizer that are retained in a connector shroud.

An electrical connector that includes a module comprising a pin block, terminal pins, a terminal stabilizer and a block seal that are retained in a connector shroud.

An electrical connector that includes terminal pins and a block seal to provide a sealed connector without any need for embedding portions of the terminal pins in a potting seal.

An electrical connector that has right angle terminal pins and a truncated shroud that is configured for direct, top down assembly to a housing having a truncated collar around an opening for access to an internal printed circuit board.

An electrical connector that includes a terminal stabilizer disposed in a socket, the terminal stabilizer that having dual function scoops that protect protruding pin heads against damage from receiving a misaligned plug connector as well as provide keying structure for assuring receipt of a proper plug connector.

An electrical connector that is configured to receive a pin alignment member after the electrical connector is attached to a housing.

An electrical connector that receives a pin alignment member that has indexing features for installation of a printed circuit board into a housing to which the modular electrical connector is attached.

DETAILED DESCRIPTION OF THE PREFERRED EMBODIMENTS

Figure 1:
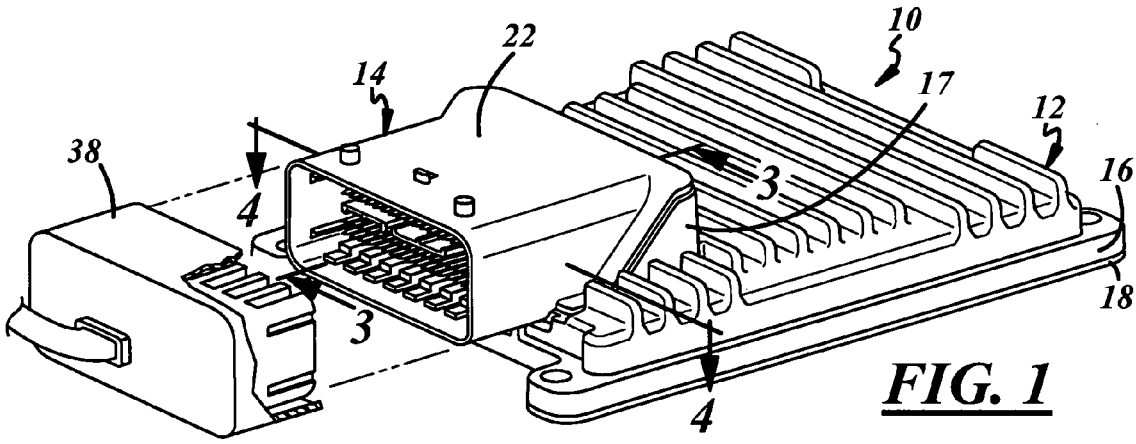
FIG. 1 is a top perspective view of an electronic assembly having an electrical connector illustrating a preferred embodiment of the invention.
Figure 2:
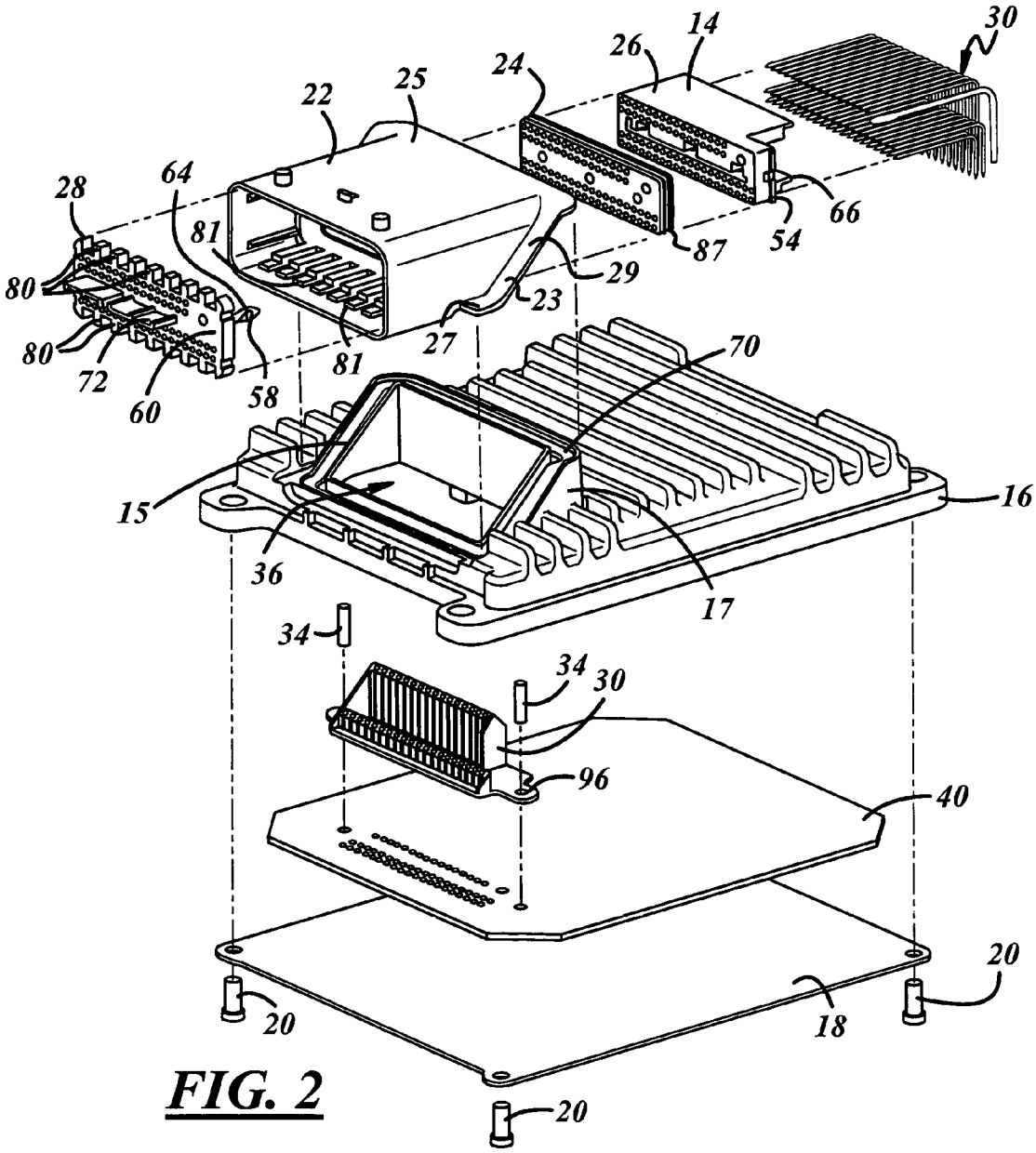
FIG. 2 is an exploded perspective view of the electronic assembly shown in FIG. 1.
Figure 3:
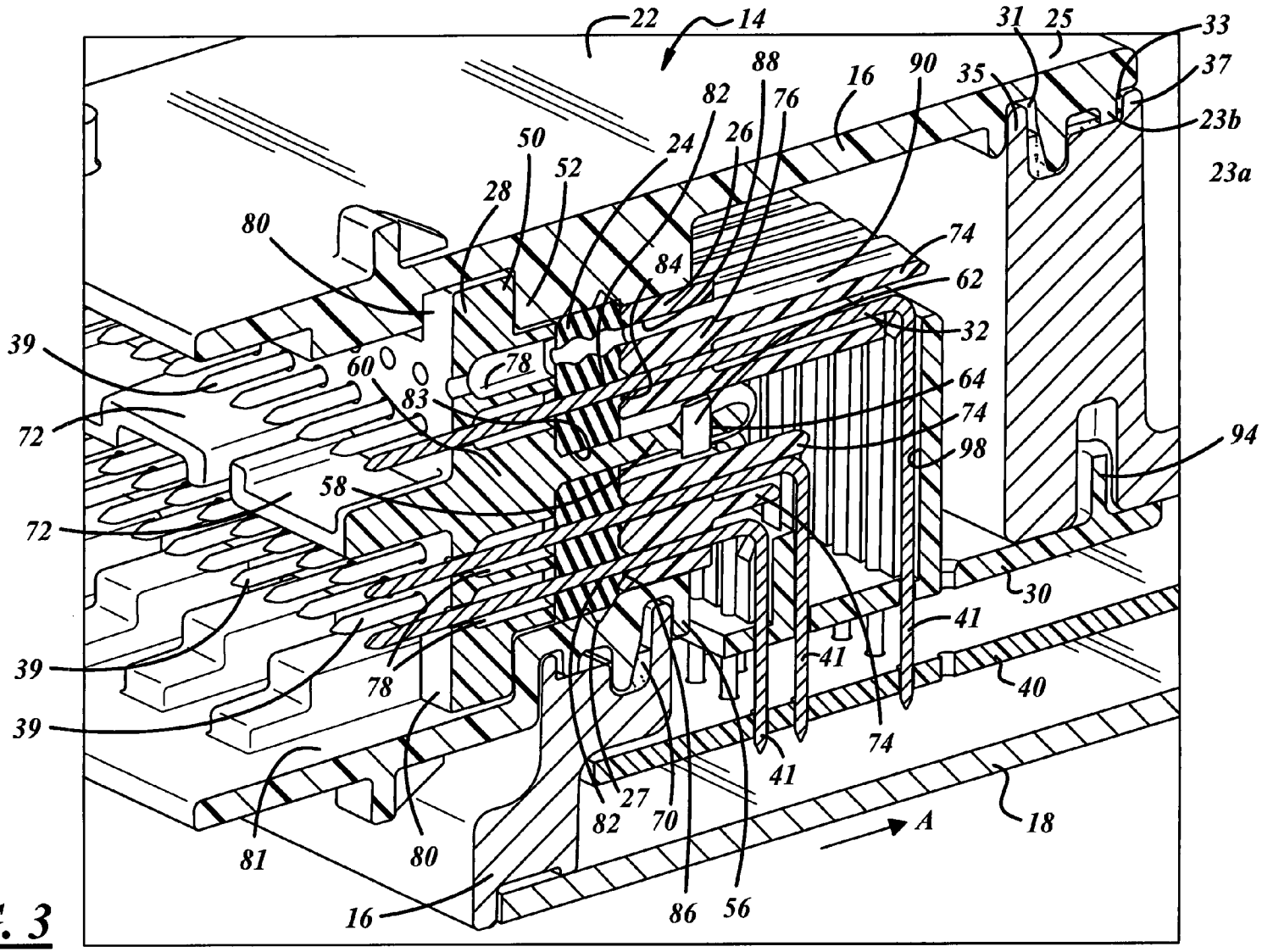
FIG. 3 is a vertically sectioned perspective view of the electronic assembly shown in FIG. 1.

An exemplary embodiment of an electrical connector according to the present invention is illustrated in FIGS. 1 to 3 wherein like numerals refer to like elements throughout the several views.

FIGS. 1 to 3 show an electronic assembly 10 which includes a die cast aluminum housing assembly 12 that has an electrical connector 14 attached to it by gluing a truncated connector shroud 22 of the electrical connector 14 to an upper, annular wall 15 of the housing assembly 12.

Housing assembly 12 is formed in a shape suitable for receiving printed circuit board 40 and includes an upper housing 16 and a lower housing 18. Upper housing 16 has a generally rectangular collar 17 that defines an opening 36 through the upper housing 16 to provide access to circuit board 40. The collar 17 is truncated at an angle to provide the upper mounting wall 15. Upper and lower housings 16, 18 are attached together with fasteners 20.

Connector 14 includes a connector shroud 22, a block seal 24, a pin block 26, a terminal stabilizer 28, a pin alignment member 30, and a plurality of terminal pins 32 that are arranged in parallel rows, three of which are shown in FIG. 3. Each of terminal pins 32 is bent at a right angle and has a head portion that extends through, pin block 26, block seal 24 and terminal stabilizer 28, and a tail portion that extends through pin alignment member 30. Pin alignment member 30 is fastened to upper housing 16 with roll pins 34. Connector 14 is positioned over the opening 36 in upper housing 16 that is defined by collar 17.

Electrical connector 14 has a connector shroud 22 that is shaped with a socket at a forward end for connection to a mating plug connector 38 shown in phantom in FIG. 1. The connector shroud 22 is truncated at an angle at a rearward end for connection to collar 17 which is also truncated at substantially the same angle, as explained below.

The block seal 24 is disposed in the connector shroud 22 where it is sandwiched between the terminal stabilizer 28 and the pin block 26. The terminal stabilizer 28 includes a flange that provides a first abutment wall 50. Connector shroud 22 includes a second abutment wall 52 which faces forward and contacts the first abutment wall 50 to prevent the terminal stabilizer 28 from being removed from the connector shroud 22 in a first direction A. The pin block 26 includes a third abutment wall 54 as best shown in FIG. 2. The connector shroud 22 includes a fourth abutment wall 56 which faces rearward and contacts the third abutment wall 54 to prevent the pin block 26 from being removed from the connector shroud 22 in a direction opposite direction A.

Figure 4:
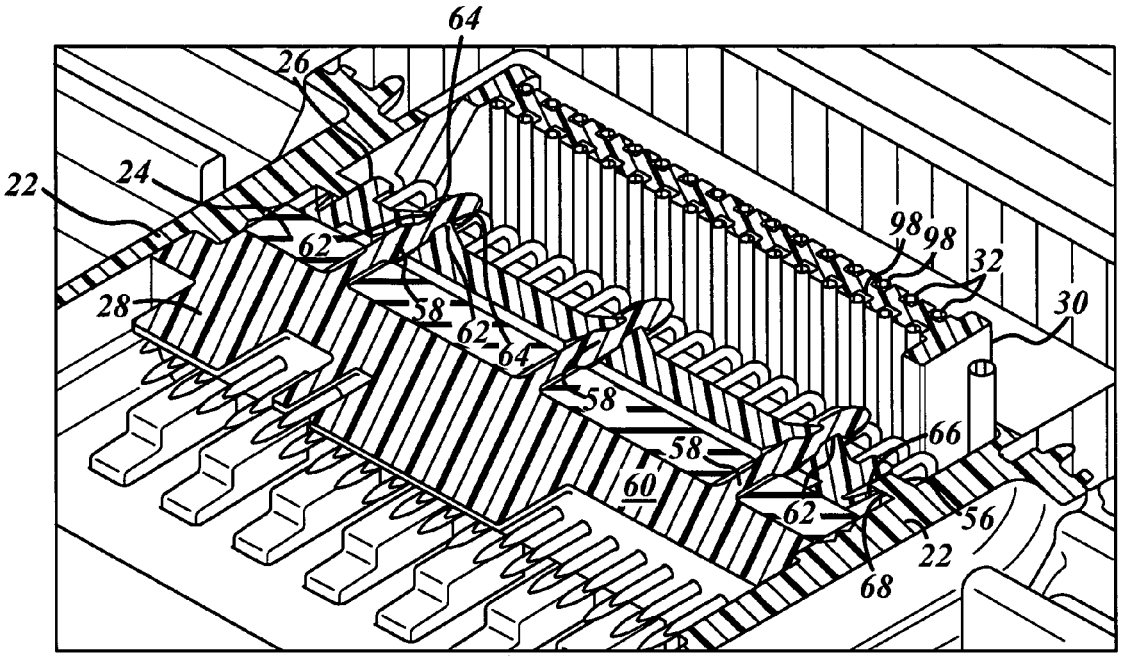
FIG. 4 is a horizontally sectioned perspective view of the electronic assembly shown in FIG. 1.

Terminal stabilizer 28 and pin block 26 have cooperating lock portions that lock the terminal stabilizer 28 and the pin block 26 together and in engagement with abutment walls 52 and 56 respectively, thus forming a module as shown in FIGS. 3 and 4.

The lock portions of terminal stabilizer 28 comprise alignment posts 58 that extend from the main body 60 of the terminal stabilizer 28 and extend through the block seal 24 and the pin block 26. The lock portions of the pin block 26 comprise first flex arms 62 which extend into slots 64 formed in the sides of the alignment posts 58 to secure the pin block 26 to the terminal stabilizer 22. The pin block 26 also includes second flex arms 66 which abut a fifth abutment wall 68 formed in the connector shroud 22 to retain the pin block 26 in the connector shroud 22 as best shown in FIG. 4. The second flex arms 66 retain the pin block 26 in connector shroud 22 until the terminal stabilizer 28 and pin block 26 are locked together by the first flex arms 62 engaging in slots 64 of alignment posts 58.

The rearward end of connector shroud 22 is truncated at a angle that matches the angle of the truncated collar 17. The truncated rearward end of connector shroud 22 has a peripheral mounting flange 23 that is shaped to engage the upper mounting wall 15 of the truncated collar 17 of upper housing 16. The peripheral mounting flange 23 comprises generally horizontal upper and lower walls 25 and 27 that are generally parallel and spaced from each other horizontally and vertically, and generally coplanar side walls 29. Side walls 29 are slanted and connect respective opposite ends of the upper and lower walls 25 and 27 to form a peripheral mounting flange 23 that is preferably continuous.

The continuous peripheral mounting flange 23 has inner and outer locating grooves 31 and 33 that cooperate with respective locating ribs 35 and 37 protruding from the upper mounting wall 15 of collar 17 to locate the peripheral mounting flange 23 properly on the upper mounting wall 15 for gluing the connector shroud 22 to the upper housing 16 as best shown in FIGS. 2 and 3. The upper mounting wall 15 of collar 17 has a glue track 70 between the locating ribs 35 and 37. Glue track 70 has an inner portion and an outer portion with the inner portion preferably being deeper than the outer portion. The mounting flange 23 of shroud 22 has inner and outer ribs 23*a* and 23*b* that protrude into the respective inner and outer portions of glue track 70 as best shown in FIG. 3. Connector shroud 22 is glued to collar 17 of upper housing 16 by running a glue bead along the glue track 70 and then pushing the connector shroud down onto the collar 17. The glue bead is preferably run along the deeper portion of the glue track so that the inner rib 23*a* protrudes into the glue bead filling the bottom of the lower portion of the glue track with any excess glue flowing into the shallower outer portion of the glue track 70 as shown in FIG. 3. This arrangement provides a strong bond and neat bond between the connector shroud 22 and the upper housing 16 when the glue sets.

Terminal pins 32 have head portions 39 projecting from a forward end of the pin block 26 and tail portions 41 projecting from a rearward end of the pin block which are bent at a right angle as best shown in FIGS. 2, 3 and 4. Terminal stabilizer 28 includes anti-scooping features 72 (FIG. 2) which extend past the terminal pins 32 (FIG. 3) and protect the head portions 39 of the terminal pins 32 against damage when mating connector 38 is plugged into the modular electrical connector 14.

Pin block 26 includes a plurality of successively longer knees 74 which extend from the main body 76 above the rows of terminal pins 32 respectively. The successively longer knees 74 preferably extend over the tail portions 41 of the terminal pins 32 in each row so as to function as a backstop and contact the tail portions 41 of the terminal pins 32 when the tail portions 41 are inserted into circuit board 40 to keep the tail portions 41 moving through openings in the circuit board 40 during insertion.

Note that electrical connector 14 can also be assembled without a block seal 24.

FIG. 2 shows terminal stabilizer 28 having a shape adapted to be inserted into the forward socket portion of connector shroud 22. Terminal stabilizer 28 has a main body 60 which has a plurality of openings 78 for receiving terminal pins 32. Three alignment posts 58 extend outwardly from main body 60. As indicated above, slots 64 are formed in the sides of each alignment post 58 for receiving first flex arms 62 of the pin block 26 to lock the terminal stabilizer 28 to the pin block 26. Alignment features 80 also extend outwardly from main body 60 of the terminal stabilizer 28 and engage slots 81 in the forward socket portion of the connector shroud 22 as best shown in FIGS. 2 and 3. The abutment wall 54 is formed in main body 60 of terminal stabilizer 28.

Block seal 24 is preferably composed of a resilient silicone material and has a plurality of openings 82 for receiving terminal pins 32 and sealing around the respective terminal pins 32. An annular compression ring 84 extends around each opening 82. Block seal 24 has openings 83 for receiving the alignment posts 58 of the terminal stabilizer 28 as best shown in FIG. 4. When electrical connector 14 is fully assembled, each compression ring 84 extends into a respective chamfered surface 86 of the pin block 26 to form a seal around one of terminal pins 32 as best shown in FIG. 3. Block seal 24 also has ribs that form a peripheral sealing surface 87 (FIG. 2) which sealingly engages an internal seal surface of the connector shroud 22 (FIG. 3).

FIGS. 2 and 3 show pin block 26 having a main body 76 which has a plurality of terminal openings 88 for receiving terminal pins 32. Knees 74 extend outwardly from main body 76. Grooves 90 are preferably formed in knees 74 with each groove being adapted to receive a respective one of the terminal pins 32. Pin block 26 includes alignment post openings 92. The first flex arms 62 extend into the alignment post openings 92 as best shown in FIGS. 3 and 4.

Pin alignment member 30 includes an alignment post 94 and openings 96 for receiving roll pins 34 that extend down from the upper housing 16. Pin alignment member 30 further includes grooves 98 for receiving the bent tail portions of the terminal pins 32 as best shown in FIGS. 3 and 4.

Electronic assembly 10 and electrical connector 14 are assembled in the following manner.

First the electrical connector 14 is processed by providing connector shroud 22 that has an opening at a forward end including a socket for receiving mating plug connector 38, a forward facing abutment wall 52, a rearward facing abutment wall 56 and an opening at a rearward end that is truncated at an angle. Pin block 26 is inserted into connector shroud 22 through the opening at the rearward end and terminal stabilizer 28 is inserted into connector shroud 22 through the opening at the forward end and locked to pin block 26 so that the terminal stabilizer 28 engages the forward facing abutment wall 52 and the pin block 26 engages the rearward facing wall 56 to retain the terminal stabilizer 28 and the pin block 26 in assembly with the connector shroud 22 shown in FIG. 3.

In the preferred embodiment illustrated in FIGS. 1-5, the terminal stabilizer 28 is locked to the pin block 26 advantageously by using alignment posts 58 that extend rearwardly from the terminal stabilizer 28. These alignment posts 58 have slots 64 that are engaged by flexible arms 62 of the pin block 26 to lock the terminal stabilizer 28 to the pin block 26.

Note that the module of the electrical connector 14 can be assembled with or without a plurality of terminal pins that extend through the pin block 26 and the terminal stabilizer 28 and also with or without block seal 24. However, it is conventional to insert the terminal pins 32 into pin block 26 before it is inserted into connector shroud 22 and bend the tail portions 41 after the pin block 26 is secured in the connector shroud 22. If block seal 24 is desired, the block seal 24 is inserted into the connector shroud 22 so that the block seal 24 is sandwiched between the pin block 26 and the terminal stabilizer 28 when the terminal stabilizer 28 is locked to the pin block 26. When the block seal 24, pin block 26 and terminal stabilizer 28 are all inserted into the connector shroud 22 to form a module, the pin block 26 is preferably inserted into the rear open end of connection shroud 22 and retained therein by flex arms 66 engaging the abutment wall 68 as best shown in FIG. 4. The seal block seal 24 is then inserted into the forward open end of the connector shroud 22 followed by the terminal stabilizer 28 which is pushed in until posts 58 are locked flex arms 64.

Figure 5:
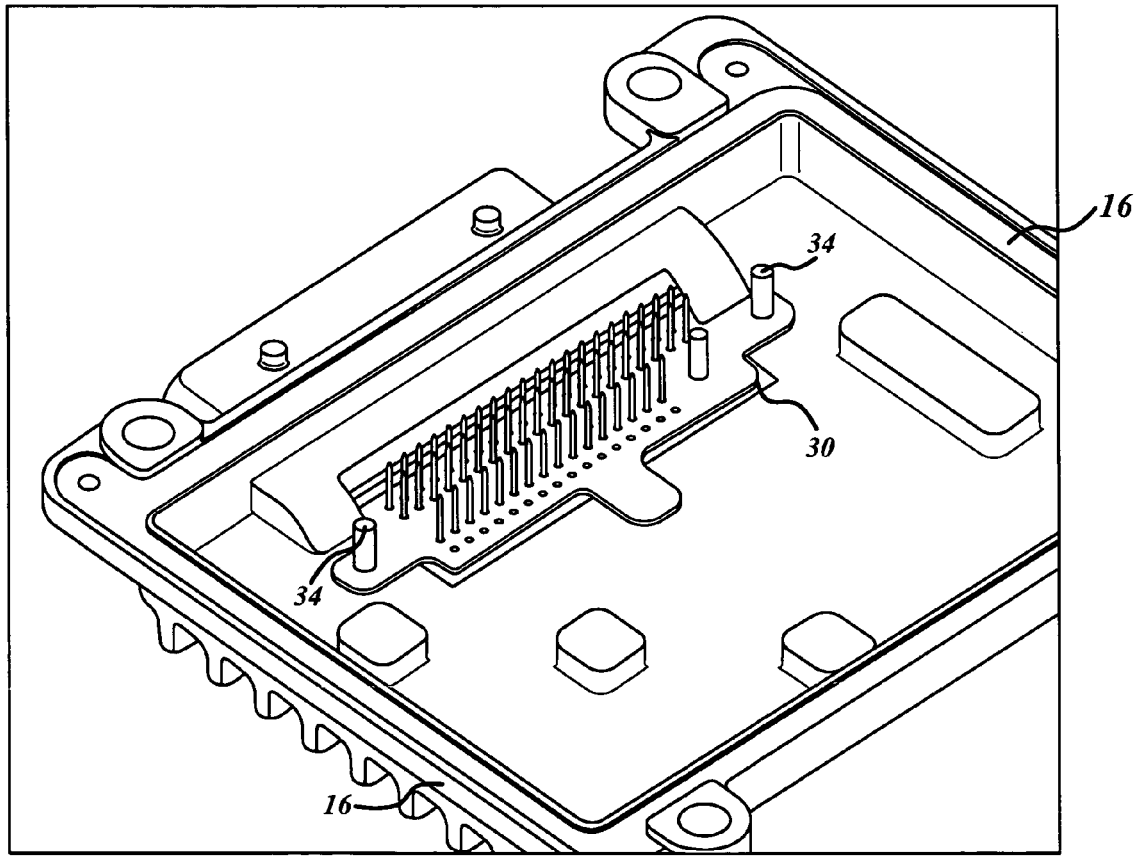
FIG. 5 is a bottom perspective view of the electronic assembly shown in FIG. 1.

After the electrical connector 14 is assembled, the electrical connector 14 is attached to upper housing 16 by a direct top down assembly by planting the peripheral mounting flange 23 on the top wall 15 of the truncated collar 17 in a vertical direction as shown in FIG. 2, that is the electrical connector 14 is moved coaxially with respect to the truncated collar 17 which is preferably shaped so that the truncated collar 17 including the mounting wall 15 with its ribs 35 and 37 and glue track 70 can be formed with an axial draw mold in a well known manner. The electrical connector 14 is preferably attached to the upper housing 16 by gluing the peripheral mounting flange 23 to the top mounting wall 15 with any suitable adhesive. This preferred method of attachment is facilitated by the cooperating locator grooves 31, 33 and ribs 35, 37 and the glue groove 70 as explained in more detail above The pin alignment member 30 is attached to upper housing 16 inside the upper housing by roll pins 34 as shown in FIG. 5. Pin alignment member 30 may be attached to upper housing 16 before the electrical connector 14 is attached to the upper housing 16. In this case, the knees 74 of the pin block 26 serve to push the pin tails through the holes in the pin alignment member 30. The printed circuit board 40 may also be in place before the electrical connector 14 is attached to the upper housing 14 (with the printed circuit board being accurately placed by the roll pins 34) so that the pin tails also push through the holes in the printed circuit board 40 when the electrical connector 14 is attached to the upper housing 16. In fact, the housing assembly 12 with pin alignment member 30 and printed circuit board 40 in place between the fastened upper and lower housings 16 and 18 may be fabricated before the electrical connector 14 is attached to the housing assembly 12.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. An electrical connector comprising;

a connector shroud having a socket at a forward end for receiving a mating plug connector, an internal forward facing abutment wall and an internal rearward facing abutment wall, a pin block disposed in the connector shroud and abutting the internal rearward facing abutment wall of the connector shroud, a terminal stabilizer disposed in the connector shroud and abutting the internal forward facing abutment wall of the connector body, the terminal stabilizer having lock portions that engage lock portions of the pin block to lock the terminal stabilizer and the pin block together and retain the terminal stabilizer and the pin block in the connector shroud to form a module, wherein the lock portions of the terminal stabilizer comprise a plurality of alignment posts that extend rearwardly and that have slots, and wherein the lock portions of the pin block comprise flex arms that engage in the slots, and wherein the terminal pins have tail portions that are bent at a right angle, and wherein the electrical connector assembly includes a pin alignment member having a plurality of through holes through which the tail portions of the pin terminals project.

2. An electrical connector of claim 1 further including a block seal that is trapped between the pin block and the terminal stabilizer, the block seal having a plurality of through holes through which respective ones of the terminal pins extend project the block seal sealing around each of the terminal pins and having a peripheral sealing surface that sealingly engages an internal seal surface of the connector shroud.

3. An electrical connector comprising;

a connector shroud having a socket at a forward end for receiving a mating plug connector, an internal forward facing abutment wall and an internal rearward facing abutment wall, a pin block disposed in the connector shroud and abutting the internal rearward facing abutment wall of the connector shroud, a terminal stabilizer disposed in the connector shroud and abutting the internal forward facing abutment wall of the connector body, the terminal stabilizer having lock portions that engage lock portions of the pin block to lock the terminal stabilizer and the pin block together and retain the terminal stabilizer and the pin block in the connector shroud to form a module, wherein the lock portions of the terminal stabilizer comprise a plurality of alignment posts that extend rearwardly and that have slots, and wherein the lock portions of the pin block comprise flex arms that engage in the slots.

4. An electrical connector comprising;

a connector shroud having a socket at a forward end for receiving a mating plug connector, an internal forward facing abutment wall and an internal rearward facing abutment wall, a pin block disposed in the connector shroud and abutting the internal rearward facing abutment wall of the connector shroud, a terminal stabilizer disposed in the connector shroud and abutting the internal forward facing abutment wall of the connector body, the terminal stabilizer having lock portions that engage lock portions of the pin block to lock the terminal stabilizer and the pin block together and retain the terminal stabilizer and the pin block in the connector shroud to form a module, wherein the terminal pins have tail portions that are bent at a right angle, and wherein the electrical connector assembly includes a pin alignment member having a plurality of through holes through which the tail portions of the pin terminals project.

5. The connector assembly of claim 1 wherein the connector shroud has a rear end that is truncated at an angle and that has a peripheral mounting flange comprising generally horizontal upper and lower walls that are generally parallel and spaced from each other horizontally and vertically, and generally coplanar side walls that are slanted and that connect respective opposite ends of the upper and lower walls to form a continuous peripheral flange.

6. An electrical connector comprising;

a connector shroud having a socket at a forward end for receiving a mating plug connector, an internal forward facing abutment wall and an internal rearward facing abutment wall, a pin block disposed in the connector shroud and abutting the internal rearward facing abutment wall of the connector shroud, a terminal stabilizer disposed in the connector shroud and abutting the internal forwarrd facing abutment wall of the connector body, the terminal stabilizer having lock portions that engage lock portions of the pin block to lock the terminal stabilizer and the pin block together and retain the terminal stabilizer and the pin block in the connector shroud to form a module, wherein the connector shroud has a rear end that is truncated at an angle and that has a peripheral mounting flange comprising generally horizontal upper and lower walls that are generally parallel and spaced from each other horizontally and vertically, and generally coplanar side walls that are slanted to connect respective opposite ends of the upper and lower walls to form a continuous peripheral flange.

7. The electrical connector of claim 4 wherein the pin block has a knee that extends over the tail portions of the terminal pins.

8. A process for making an electrical connector comprising;

providing a connector shroud having a socket at a forward end for receiving a mating plug connector, a forward facing abutment wall, a rearward facing abutment wall and an opening at a rearward end, inserting a pin block into the connector shroud through the opening at the rearward end, inserting a terminal stabilizer into the connector shroud through the opening at the forward end, and locking the terminal stabilizer to the pin block so that the terminal stabilizer engages the forward facing abutment wall and the pin block engages the rearward facing wall to retain the terminal stabilizer and the pin block in assembly with the connector shroud, wherein the terminal stabilizer is locked to the pin block by posts that extend rearwardly from the terminal stabilizer and that have slots that are engaged by flex arms of the pin block,and wherein the terminal pins have tail portions that are bent at a right angle, and wherein the electrical connector assembly includes pin alignment member having a plurality of through holes through which the tail portions of the pin terminals project.

9. The process as defined in claim 8 wherein the terminal stabilizer is locked to the pin block by posts that extend rearwardly from the terminal stabilizer and that have slots that are engaged by flex arms of the pin block.

10. A process for making an electrical connector comprising;

providing a connector shroud having a socket at a forward end for receiving a mating plug connectr, a forward facing abutment wall, a rearward facing abutment wall and an opening at a rearward end, inserting a pin block into the connector shroud through the opening at the rearward end, inserting a terminal stabilizer into the connector shroud through the opening at the forward end, and locking the terminal stabilizer to the pin block so that the terminal stabilizer engages the forward facing abutment wall and the pin block engages the rearward facing wall to retain the terminal stabilizer and the pin block in assembly with the connector shroud, wherein the terminal stabilizer is locked to the pin block by posts that extend rearwardly from the terminal stabilizer and that have slots that are engaged by flex arms of the pin block.

11. The combination comprising an electrical connector and a housing, the electrical connector having a connector shroud having a socket at a forward end for receiving a mating plug connector, a pin block disposed in the connector shroud and supporting a plurality of terminal pins that are arranged in horizontal rows that are vertically spaced with the terminal pins in each row being laterally spaced from each other, the terminal pins having head portions projecting out a forward end of the pin block and tail portions projecting out a rearward end of the pin block, and the connector shroud having a rear end that is truncated at an angle, the housing having a collar that is truncated at an angle and that defines an opening, the truncated collar having a mounting wall that is engaged by the rear end of the connector shroud, and means to attach the connector shroud to the truncated collar of the housing.

12. The combination as defined in claim 11 wherein, the connector shroud has an internal forward facing abutment wall and an internal rearward facing abutment wall, the pin block abuts the internal rearward facing abutment wall of the connector shroud, a terminal stabilizer is disposed in the connector shroud and abuts the internal forward facing abutment wall of the connector shroud, the terminal stabilizer has a plurality of through holes through which respective ones of the head portions of the terminal pins extend, the terminal stabilizer has lock portions that engage lock portions of the pin block to lock the terminal stabilizer and the pin block together and retain the terminal stabilizer and the pin block in the connector shroud to form a module, and the rear end of the connector shroud has a peripheral mounting flange comprising generally horizontal upper and lower walls that are generally parallel and spaced from each other horizontally and vertically, and generally coplanar side walls that are slanted and that connect respective opposite ends of the upper and lower walls to form a continuous peripheral mounting flange, and the mounting wall of the truncated collar is engaged by the peripheral mounting flange of the connector shroud.

13. The combination as defined in claim 11 wherein, the rear end of the connector shroud has a peripheral mounting flange comprising generally horizontal upper and lower walls that are generally parallel and spaced from each other horizontally and vertically, and generally coplanar side walls that are slanted and that connect respective opposite ends of the upper and lower walls to form a continuous peripheral mounting flange, and the mounting wall of the truncated collar is engaged by the peripheral mounting flange of the connector shroud.

14. The combination as defined in claim 13 wherein the mounting wall of the truncated collar has a continuous glue track and the peripheral mounting flange of the connector shroud is glued to the truncated collar of the housing.

15. The combination as defined in claim 14 wherein the mounting wall of the truncated collar has locating ribs that cooperate with inner and outer locating grooves to locate the peripheral mounting flange of the connector shroud with respect to the mounting wall of the truncated collar.

16. The combination as defined in claim 14 wherein the continuous glue track has an inner portion and an outer portion with the inner portion being deeper than the outer portion and wherein the peripheral mounting flange of the connector shroud has inner and outer ribs that protrude into the respective inner and outer portions of the glue track.

* * * * *